US005431083A

United States Patent [19]

Vassioukevitch

[11] Patent Number: 5,431,083

[45] Date of Patent: Jul. 11, 1995

[54] SEGMENTED ELECTROMAGNETIC LAUNCHER

[75] Inventor: Petr Vassioukevitch, Brooklyn, N.Y.

[73] Assignee: Lioudmila A. Glouchko, Brooklyn, N.Y.

[21] Appl. No.: 186,647

[22] Filed: Jan. 26, 1994

[51] Int. Cl.[6] ..... F41B 6/00

[52] U.S. Cl. ..... 89/8; 124/3

[58] Field of Search ..... 89/8; 124/3

[56] References Cited

U.S. PATENT DOCUMENTS

| | | | |
|---|---|---|---|
| 1,370,200 | 3/1921 | Fauchon-Villeplee | 89/8 |
| 2,870,675 | 1/1959 | Salisbury | 89/8 |
| 4,457,205 | 7/1984 | Ross | 89/8 |
| 4,930,395 | 6/1990 | Loffler | 89/8 |
| 4,945,810 | 8/1990 | Parker | 89/8 |
| 5,133,241 | 7/1992 | Koyama et al. | 89/8 |

FOREIGN PATENT DOCUMENTS

| | | | |
|---|---|---|---|
| 130396 | 5/1990 | Japan | 124/3 |

*Primary Examiner*—Stephen C. Bentley

[57] ABSTRACT

A segmented electromagnetic launcher, comprising a solid rail (20) and a segmented rail (21), formed from segments (22*a* to 22*z*) with number of segments greater than one, isolated from one another. These two rails are positioned parallel to and spaced apart from one another, forming a barrel (3) with breech (4) and muzzle (5) ends for sliding a projectile with armature (23) inside the barrel. Two supply conductors (24*a*, 24*b*) are positioned on either side and parallel to the solid rail (20) and isolated from it; side supply conductors (25*a* to 25*z*, 26*a* to 26*z*) are positioned on either side of the bore of the barrel with the number of side supply conductors two times the number of the segments. Each segment (22*k*) is connected wtih two supply conductors (24*a*, 24*b*) by two side supply conductors (25*k*, 26*k*) in connection points (27*a* to 27*z*, 28*a* to 28*z*) located at the breech end of each segment. The solid rail and both of supply conductors having electrical terminals are disposed close to one another and form one group from three electrical terminals. Two of the same polarity terminals of two single phase identical sources of electrical power (29*a*, 29*b*) are connected together and to the terminal of the solid rail (20). Another two terminals of the opposite polarity of the single phase identical sources of electrical power are connected to the terminals of the supply conductors (24*a*, 24*b*). The rails, supply conductors and side supply conductors are formed from conductive material and isolated one from another with insulating layers (not shown here).

1 Claim, 5 Drawing Sheets

(I1+I2)/2
F1/2
F2/2
I1/2
I2/2
"d"
De
Dc

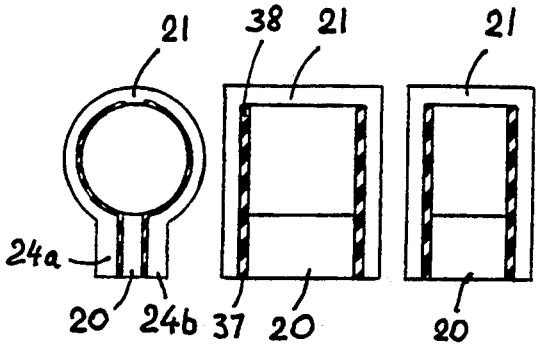
FIG.9A FIG.9B FIG.9C
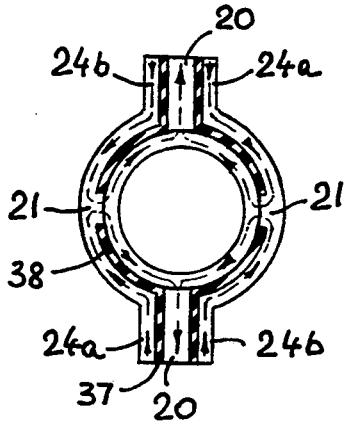
FIG.10
FIG.11A
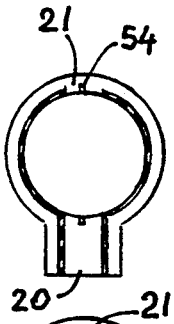
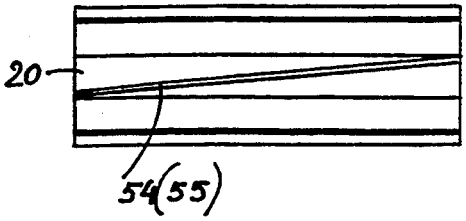
FIG.11C
FIG.11B
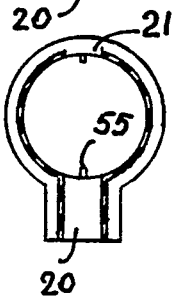

SEGMENTED ELECTROMAGNETIC LAUNCHER

FIELD OF THE INVENTION

The invention relates to electromagnetic projectile launchers or railguns and, in particular, to the construction of the barrels for the segmented electromagnetic launcher.

BACKGROUND OF THE INVENTION

Heretofore there have been a number of different types of electromagnetic launchers with rails.

FIG. 12 schematically illustrates the general construction of a conventional electromagnetic railgun. The railgun includes a pair of rails 1 and 2 positioned parallel to and spaced apart from one another. Rails 1 and 2 form barrel 3 which includes breech end 4 and muzzle end 5. Armature 6 is sized so as to slide between rails 1 and 2. The armature 6 and the projectile 7 may be combined into one body, or may be the same body. Rails I and 2 are connected to a source of electrical power 8.

The next explanation will define the operation. When the armature 6 is in the barrel 3, current begins to flow between the rails 1 and 2 through the armature 6. This current produces a magnetic field to the left of the armature. This magnetic field interacts with the current flowing through the armature via path 9, to create an electromagnetic force that causes the armature to accelerate to the right along barrel 3, and out of the muzzle end 5 of the railgun.

In another type of railgun, known as a plasma armature railgun, current flows along path 10 through a plasma created by the electric current between the rails to the left of an electrically insulating projectile 7 which is used in place of the armature 6. Current running through the plasma interacts with the magnetic field generated by the current in the rails and results in acceleration of the plasma, and therefore of the insulating projectile, to the right along barrel 3.

A primary objective of electromagnetic launcher design is to maximize efficiency by minimizing energy losses in the electromagnetic launcher system.

Some sources of energy loss in an electromagnetic launcher system are:

- resistive losses in the rails and any supply conductors, loss in the plasma behind the projectile and/or in the armature of projectile
- loss of the energy due to the force of friction between the projectile and the walls of the barrel bore
- loss of energy stored in the magnetic field from the rail current, which is dissipated in muzzle resistors after each shot.

The present invention reduces the energy stored in the magnetic field from the rail current.

In U.S. Pat. No. 4,796,511 to Eyssa, the author makes an attempt to reduce these losses by segmentation of the rails and by special supply conductors (See FIG. 13). Both supply conductors 11 and 12 have two semi-cylindrical portions: 13 and 14 for supply conductor 11, and 15 and 16 for supply conductor 12, respectively.

The portions 13 and 14 are electrically connected with segmented rail 17 and the portions IS and 16 are electrically connected with segmented rail 18. These semi-cylindrical portions are disposed on either side of the projectile path between the rails and in generally coaxial relationship to one another.

The author supposes that because the semi-cylindrical portions are coaxially arranged the magnetic field from current in such portions will not exist inside of barrel.

Because the currents flow in opposite directions in nonsymmetrical coaxial supply conductors, the currents are repelled by one another and the density of current will be distributed as shown in FIG. 13. These currents will create a magnetic field 19 inside the barrel and the stored magnetic energy will be lost after each shot.

SUMMARY OF THE INVENTION

The present invention provides a reduction of the volume of magnetic energy stored in the magnetic field created by the rail current by reducing the volume of space occupied by this magnetic field but not reducing the density of this magnetic energy.

One aspect of the present invention provides for a change in volume of the magnetic field to the left of the armature from minimum to maximum as the projectile moves down the length of the barrel by switching the current from segment to segment of segmented rail. The other rail is solid.

Part of the energy stored in the volume formed by the previous segment transforms into the volume formed by the next segment of the segmented rail as the projectile moves down the length of the barrel. Another part of this energy dissipates in an arc which appears between neighbouring segments. Only a small part of the stored energy in the volume formed at the last segment will be dissipated by muzzle resistors.

The movement of the volume with the magnetic field behind the armature is possible due to two supply conductors which are maintained on either side and parallel of solid rail and due to some side supply conductors which electrically connect each segment of segmented rail with each supply conductor. The side supply conductors are positioned on either of the bore of the barrel.

The solid rail, the segments of the segmented rail and the supply conductors are separated and electrically isolated from one another by an insulating material. The side supply conductors are separated and electrically isolated from one another and from the solid rail by insulating material.

In general any number of segments of the segmented rail greater than one may be employed. The number of side supply conductors is two times more than the number of segments of segmented rail.

The segments forming the segmented rail are positioned such that their rail surfaces form a substantially continuous barrel surface. The segmented rail and the solid rail are positioned such that their barrel surfaces are parallel to and spaced apart from one another, so as to define a barrel having a longitudinal axis, a breech and a muzzle end.

Two separate power sources have to be used to support identical currents in the supply conductors.

None of the prior electromagnetic launchers disclose the novel combination of the segmented electromagnetic launcher (hereafter called "railgun") as described herein.

The advantages and objects of the invention will become evident from the following detailed description when read in conjunction with the accompanying drawings which illustrate the preferred embodiments of the invention.

DESCRIPTION OF THE DRAWINGS

FIG. 3A to 3E are explanatory diagrams showing a timewise change of the movement of the projectile and a flow of electric current in details concerning an embodiment of the present invention.

FIG. 4A, 4B and 4C are front views of a railgun according to the present invention.

FIG. 6 is a perspective view of FIG. 5A to FIG. 5D.

FIG. 7 is a partial cutaway perspective view showing an another embodiment of the present invention.

FIG. 9A to 9C are side views showing any given cross-section of the barrel.

FIG. 10 is a side view showing another embodiment of an electromagnetic rail launcher according to the present invention.

FIG. 11A to 11C are two side views and a sectional diagram, respectively, showing an important part of the other embodiment.

DESCRIPTION OF PREFERRED EMBODIMENTS

Figure 1:
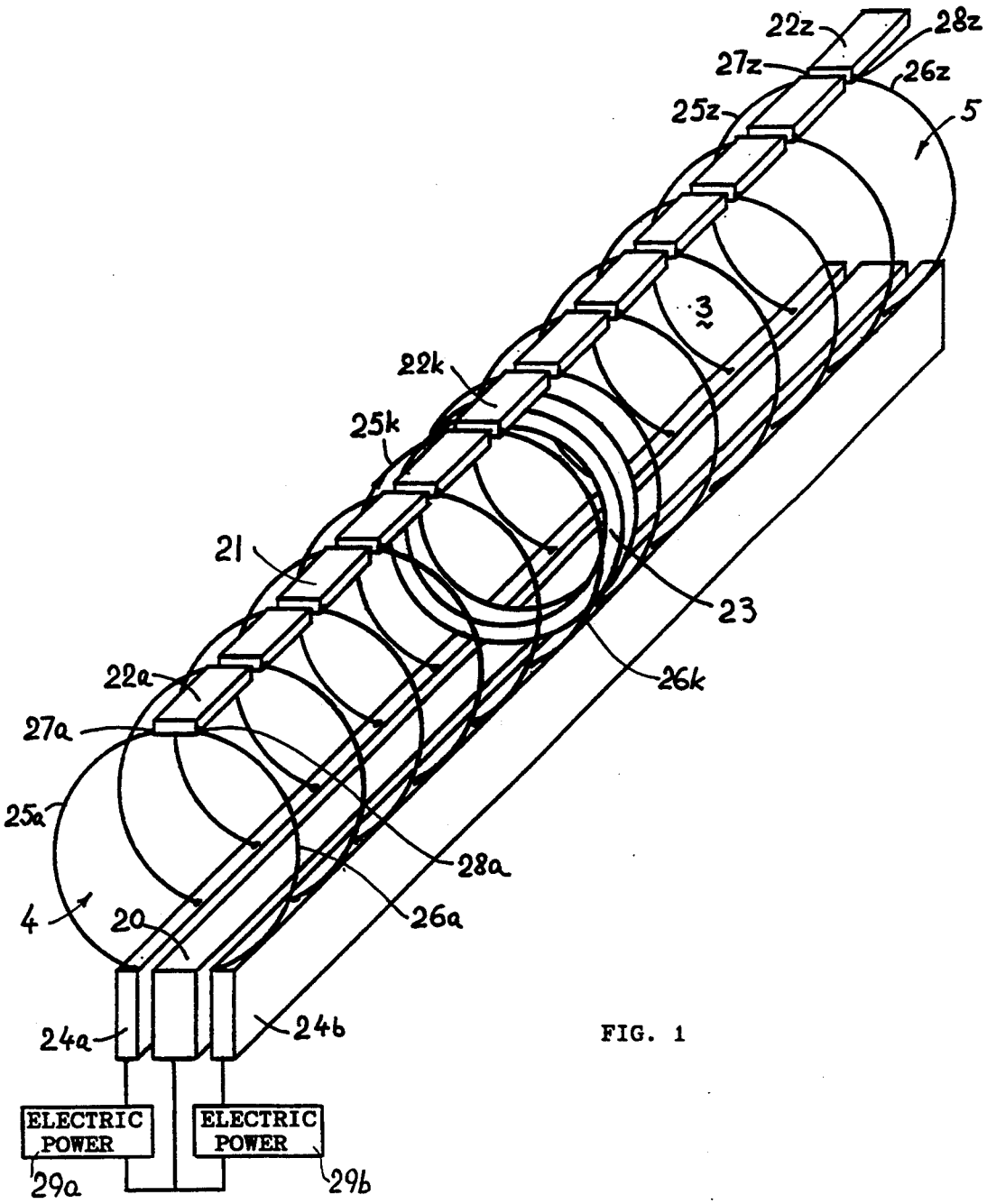
FIG. 1 is a perspective view of a railgun according to the present invention.

An embodiment of the present invention will be explained referring to the drawings, wherein the same reference numerals designate the same or corresponding parts.

FIG. 1 is a perspective view of a railgun the present invention. In FIG. 1 a numeral 20 signifies the solid rail and a numeral 21 signifies the segmented rail, consisting of the segments 22*a* to 22*z*. Segments 22*a* to 22*z*, forming segmented rail 21, are positioned such that their rail surfaces form a substantially continuous barrel surface. Rails 20 and 21 are positioned parallel to and spaced apart from one another so as to make contact with armature 6, formed like a conductive ring 23. (Projectile 7 is not shown on FIG. 1). The rails together form barrel 3 including breech end 4 and muzzle end 5. The supply conductors 24*a* and 24*b* are positioned on either side and parallel to the solid rail 20. The side supply conductors 25*a* to 25*z* and 26*a* to 26*z* are maintained on either side of the bore of the barrel 3. The side supply conductors 25*a* to 25*z* and 26*a* to 26*z* electrically connect each segment 22*a* to 22*z* of segmented rail 21 with supply conductor 24*a* and 24*b*. Connection points 27*a* to 27*z* and 28*a* to 28*z* for each of segments 22*a* to 22*z* are located at the breech end of the segments 22*a* to 22*z* of segmented rail 21 such that when armature 23 first makes contact with the rail surfaces of these segments, the armature has already moved past the connection points. The reason for this arrangement is set forth below.

Any number of segments 22 of segmented rail 21 greater than one may be employed. The number of side supply conductors 25 equals the number of side supply conductors 26. The total number of all side supply conductors 25 and 26 is two times the number of segments 22 of segmented rail 21. The solid rail 20,the segments 22 of segmented rail 21 and supply conductors 24*a* and 24*b* are separated and electrically isolated from one another by an insulating material. The side supply conductors 25 and 26 are separated and electrically isolated from one another and from the solid rail 20 by an isolating material (The isolating materials are not shown on FIG. 1). Two single phase identical sources of electrical power 29*a* and 29*b* are connected to one another and with the solid rail 20 and supply conductors 24*a* and 24*b*. Two terminals of the same polarity of the sources 29*a* and 29*b* connect with the solid rail 20, and another two terminals of opposite polarity connect with the supply conductors 24*a* and 24*b*. These terminals are disposed close to one another and form one group of three electrical terminals.

The next explanation will define the operation.

The sources of electricity 29*a* and 29*b* provide pulses of currents through the solid rail 20 and thence to the conductive ring 23 and thence to segment 22*k* of segmented rail 21 and thence to side supply conductors 25*k* and 26*k* and thence to supply conductors 24*a* and 24*b*. These currents will be flowing down the solid rail 20 in one direction and flowing in the opposite direction in the supply conductors 24*a* and 24*b*. Because the solid rail 20 and two supply conductors 24*a* and 24*b* are positioned very closely, the magnetic fields from the currents in these parts of solid rail 20 and supply conductors 24*a* and 24*b* will be substantially confined to the space between the solid rail 20 and supply conductors 24*a* and 24*b*, and very little magnetic field from these currents will exist in the space outwardly or inwardly of the solid rail and supply conductors. The currents in the supply conductors 24*a* and 24*b* are equal to each other.

At the same time these currents will create the magnetic field in the space between the armature and the nearest side supply conductors but to the left of the armature. This magnetic field interacts with the currents flowing through the armature to create an electromagnetic force which causes the armature to accelerate to the right along barrel 3. So the space with the magnetic field in the electromagnetic launcher according to the present invention is limited to the part of barrel between the nearest side supply conductors and the armature.

Figure 2A:
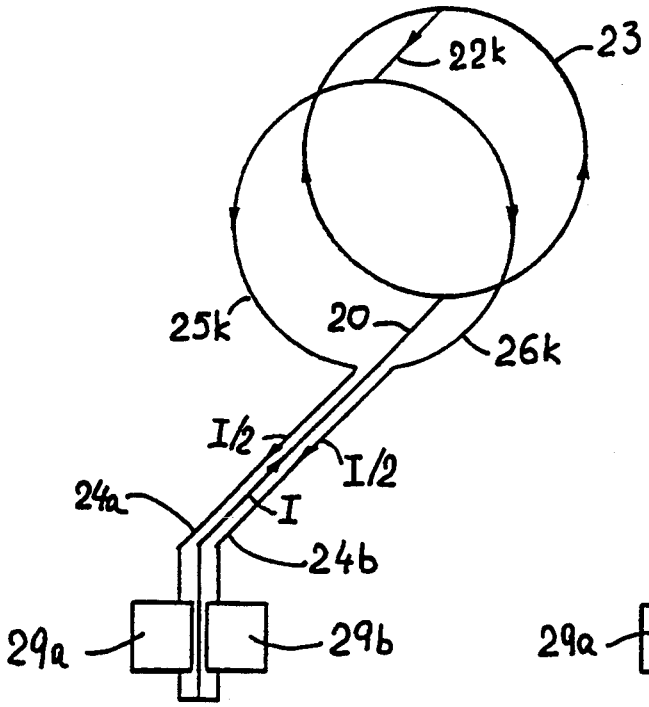
FIG. 2A and 2B are schematic diagrams of the railgun according to the present invention with a solid armature and a plasma armature, respectively.
Figure 2B:
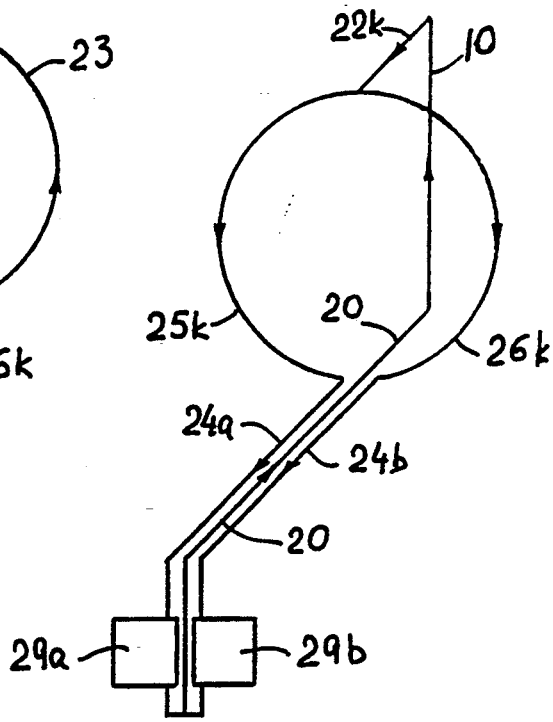

FIG. 2A and FIG. 2B are partial perspective views of the railgun according to the present invention with the solid armature and the plasma armature, respectively, showing the fragments with currents. The currents of the solid armature formed like a conductive ring 23 flow to two parallel circuits (see FIG. 2A). The plasma armature is repelled from the walls of the barrel by electromagnetic force and exist in the middle of the bore of the barrel between the solid rail 20 and segment 22*k* of segmented rail 21 (see FIG. 2B). Due to this effect the insulation material of electromagnetic launcher according to the present invention is destroyed less than it would be by a conventional electromagnetic railgun.

FIG. 3A to 3E are explanatory diagrams successively showing the action of a railgun according to the invention. The projectile 7 with armature 6 is accelerated to an initial velocity by any propulsion like a light gas gun accelerator (FIG. 3A). Armature 6 is sized such that it makes sliding electrical contact with the inner surfaces of the solid rail 20 and segments 22*a* to 22*z* of segmented rail 21.

When armature 6 reaches the point at which its leading end makes electrical contact with the rail surfaces of the barrel 3, an electrical current flow between segment 22*a* and rail 20 through the armature 6 (see FIG. 3B). Connection points 27*a* and 28*a* are located at the breech end of the segment 22*a* such that when armature 6 first makes contact with the segment surface, the armature has already moved past the connection points. The length of each segment should be greater than the full length of the armature. The armature has electrical contact with solid rail 20 anytime the armature is in the barrel 3. As a result the current loop 30 is created in the railgun (see FIG. 3B). As is known to those skilled in this art, the electromagnetic forces resulting from the current tend to expand the current loop, by accelerating the armature towards the muzzle end 5 of the barrel 3. In any position of the armature, i.e. as shown in FIG. 3B, the voltage V between the nearest segments 22*a* and 22*b* and between any two segments equals zero. The process described above continues as the armature reaches each segment of segmented rail 21. The magnetic energy accumulated in the current loop 30 is equal to L·I 2/2 (Joule), where L is the inductance of the loop 30 and I is the a current, flowing through the armature.

Next, when the projectile 7 with the armature 6 is accelerated and moved down the length of the barrel, the armature 6 reaches the next segment 22*b*, as shown in FIG. 3C, and has electrical contact with the inner surface of this segment. An arc 31 between the segment 22*a* and the armature 6 is formed by voltage $L \cdot dI/dT > 0$ to discharge the accumulated energy L·I 2/2, where dI/dT is a derivative of current I by time T. Part of this energy transforms into the current loop 32 by a mutual inductance between the loops 30 and 32, another part transforms to the kinetic energy of the projectile, and the third part of this energy transforms into heat energy for any gas in the barrel and part of the heat energy transforms into the kinetic energy of the projectile. Finally,the magnetic energy in the space between segment 22*a* and rail 20 is transformed wholly. The process continues as the armature 6 reaches the next segment 22*c*, as shown in FIG. 3D.

When the projectile 7 with armature 6 leaves the barrel 3, the magnetic energy which has been accumulated in the space between the last segment 22*z* and rail 20 will be dissipated in muzzle resistors of arcs 33 and 34,as shown in FIG. 5E. This energy is much less than that accumulated in the magnetic field of a conventional railgun. The same process will exist for the plasma armature.

The efficiency of a railgun according to present invention is more than that of prior art because part of the magnetic energy accumulated in the magnetic field is utilized to accelerate the projectile. Moreover, the size of the current loop is less and therefor the electromagnetic forces are more than those in the conventional railgun.

Another major advantage of the present invention is that current can be supplied to and drawn from the supply conductors at any spot, or several spots together of the barrel. FIG. 4A to 4C illustrate three spots of connection of the group of terminals 35: the point nearest to the breech end, to the middle part and to the muzzle end of the barrel, respectively. It is possible since the currents flowing through the solid rail 20 in one direction and side supply conductors 24*a* and 24*b* in the opposite direction do not create the magnetic field which drives the projectile. Using several terminals to supply electrical energy to the railgun reduces the resistive losses.

Figures 5A, 5B, 5C, 5D:
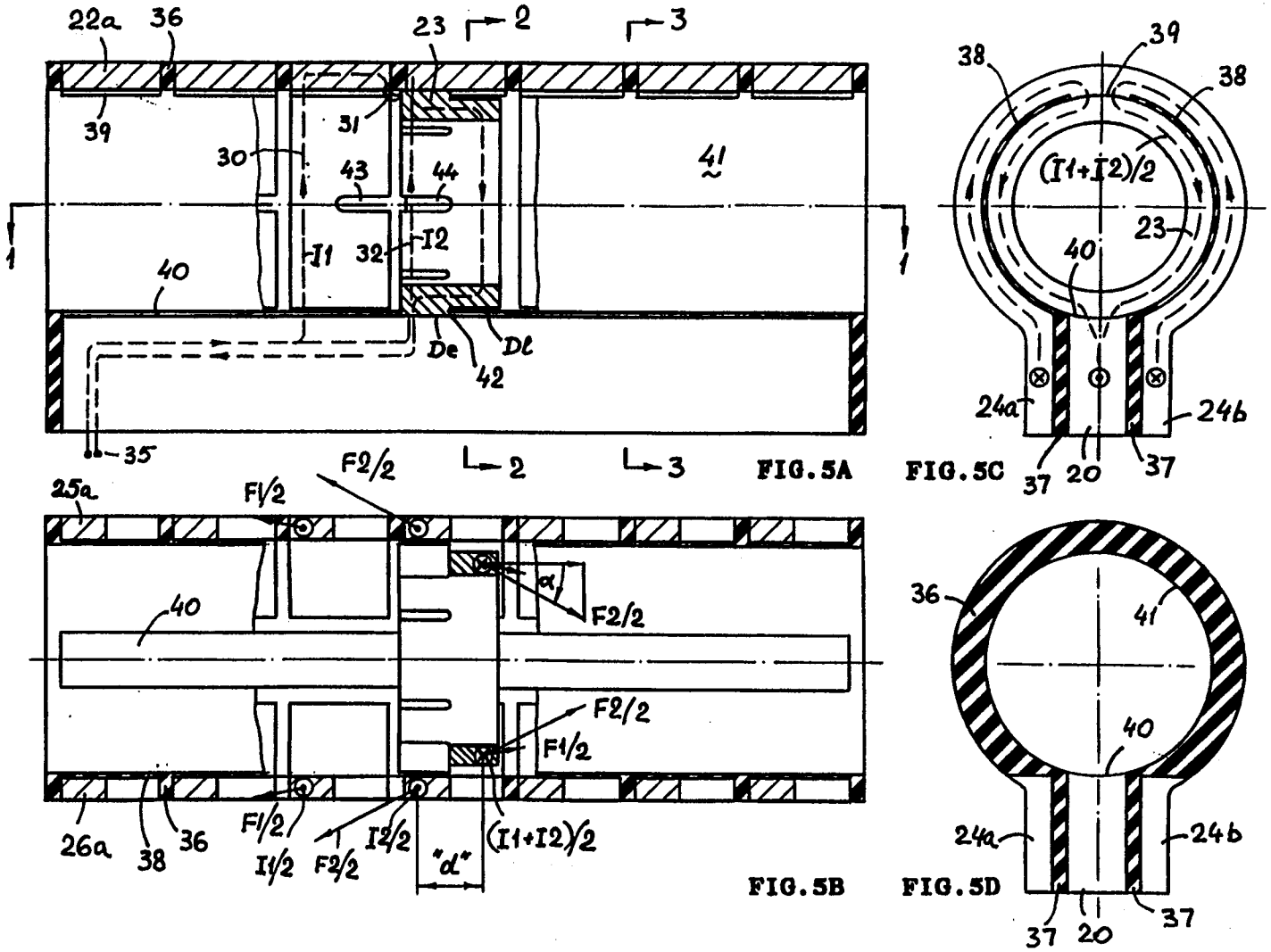
FIG. 5A is a sectional diagram.
FIG. 5B is a cross-sectional view down the length of the barrel of FIG. 5A taken generally along the lines 1—1.
FIG. 5C and 5D are cross-sectional views through the barrel of FIG. 5A taken generally along the lines 2—2 and 3—3 respectively, showing important parts of another embodiment of an electromagnetic rail launcher of this invention.
Figure 12:
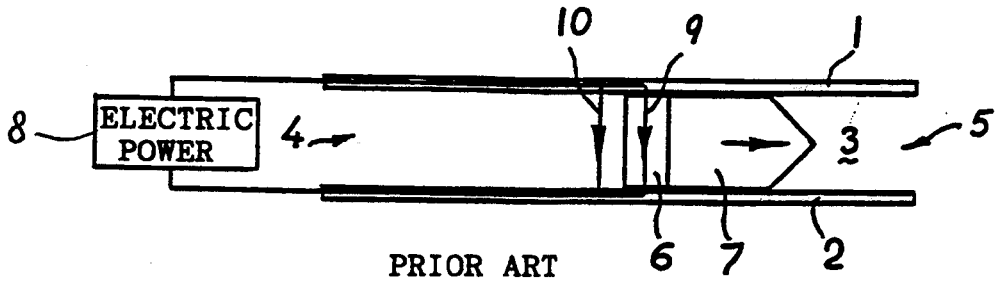
PRIOR ART FIG. 12
FIG. 12 is a construction diagram showing a conventional electromagnetic rail launcher.
Figure 13:
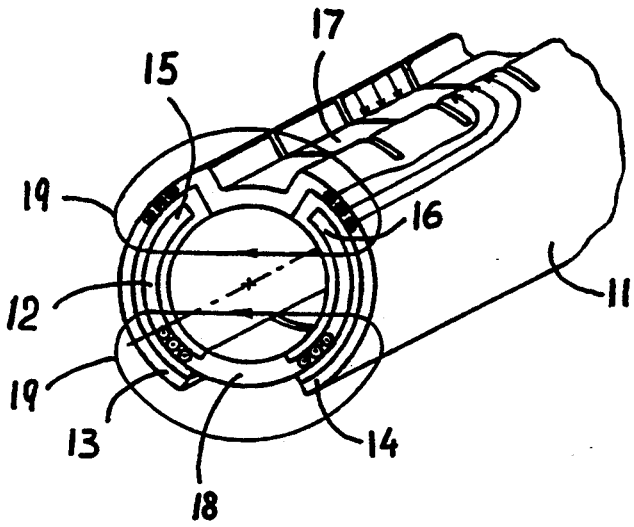
PRIOR ART FIG. 13
FIG. 13 is a schematic diagram of a prior railgun.

As above, the side supply conductors 25*a* to 25*z* and 26*a* to 26*z* and the connections 27*a* to 27*z* and 28*a* to 28*z* are shown schematically only. It should be understood that these would preferably extend over a substantial portion of the cross-section of supply conductors 24*a* and 24*b* and segments 22*a* and 22*z*. Moreover, for convenience in construction and assembly of the barrel, the supply conductors 24*a* and 24*b*, all side supply conductors 25 and 26, and all segments 22 of segmented rail 21 may be formed of one piece extending the length of the barrel, as illustrated in the views of FIG. 5A to FIG. 5D, where FIG. 5A is as sectional diagram of the railgun of FIG. 1, and FIG. 5B is a cross-sectional view down the length of the barrel of FIG. 5A taken generally along the lines 1—1, and FIG. 5C and FIG. 5D are cross-sectional views through the barrel of FIG. 5A, taken generally along the lines 2—2 and 3—3, respectively, showing important parts of another embodiment of an electromagnetic rail launcher of present invention.

As stated, according to the above embodiment, the segments 22 and side supply conductors 25 and 26 are separated and electrically isolated from one another by layers 36 of insulating material. Insulators 37 are positioned between the solid rail 20 and the supply conductors 24*a* and 24*b*, to electrically insulate the solid rail and both supply conductors from one another (see FIG. 5C and 5D). The inner surface of side supply conductors 25 and 26 are covered by layer 38 of insulating material which are formed integrally with the insulators 36 and 37 such that segment surface 39 of segmented rail 21, rail surface 40 of solid rail 20 and inner surface 41 of integrally insulating material 38 form a smooth barrel surface. The armature 6 (the conductive ring 23) slides down the length of the barrel in such away that it makes sliding electrical contact with the inner surface of segments 22 and solid rail 20 (the projectile 7 is not shown in FIG. 5A to FIG. 5D).

To create the current loop 30, when the conductive ring 23 reaches the point at which its leading end (spot 42) makes electrical contact with the next segment.22, each side supply conductors 25 and 26 on the right side has a slot 43, and the conductive ring 23 has the same slots 44 but on the opposite side, i.e. left side. It can be appreciated that alternative arrangements for the side supply conductors are possible. Specifically, the side supply conductors and armature may have different shapes from those illustrated in FIG. 5A to FIG. 5D. For example, the diameter of the leading part of the armature (diameter D1) may be less than that of the end part, as shown on FIG. 5A (diameter De). As illustrated in FIG. 5A to 5C, the currents I1 and I2 of the loops 30 and 32, respectively, flow through the conductive ring 23. There is the arc 31 in the circuit with current II of the loop 30. The electromagnetic forces F1 and F2 move the conductive ring 23. The same forces act on the side supply conductors 25 and 26. The useful constituent of each force is $F \cdot COS(\alpha)$, where $\alpha$ is an angle between the longitudiual axis of railgun and vector of force. If a distance "d" between the currents in the side supply conductors and armature is reduced then the useful constituent of force is reduced because $COS(\alpha)$ is reduced. If this distance is increased the useful constituent of force is reduced too because the force F is reduced. There is an optimum distance "d" to make electrical contact between the armature and the next segment of segmented rail to obtain the maximum efficiency of the railgun. It is possible to make this contact when the distance is "d", zero or "-d", because the circuits of supply conductors have small inductances and the current trough the inductance can not be spasmodic. The optimum distance "d" depends on the power of the energy source, on the resistances of the circuit and on the speed of the projectile. It is possible that the optimum distance may be positive or negative. This process can be compared with the one in an internal-combustion engine where the ignition timing can be done before, on time or after the "Top Dead Center" of a piston. The ignition timing is changed depending on operating conditions of the engine.

FIG. 6 is a perspective view of the railgun of FIG. 5A to FIG. 5D showing the method of increasing the hardness of the barrel. The side supply conductors 25 and 26 and the segments 22 of segmented rail 21 have ribs 45. Bars 46 join the ribs 45 to increase the strength of the barrel of the railgun. Reactive electromagnetic forces are supplied to the side supply conductors and move down the length of the barrel together with the projectile. The bars 46 transfer these forces on a stator of railgun (not shown). The bars 46 and the ribs 45 are electrically isolated from one another by layers (not shown) of insulating material. In another way, the bars 46 may be formed from insulation material.

FIG. 7 shows another embodiment of the present invention. For convenience in construction and assembly of the barrel, and to reduce losses from self-induced currents, the side supply conductors and supply conductors are formed from Litz's wire. The solid rail 20, the supply conductors 24*a* and 24*b* and the all side supply conductors 25 and 26 are integrated by insulating material in a monolith 47 such that segment surfaces 39 of segmented rail 21, the rail surface 40 of solid rail 20 and inner surface 48 of the monolith 47 form a smooth barrel surface. The monolith can have ribs to reduce the weight of the barrel and to increase the efficiency of heat transmission. To increase the efficiency of cooling the railgun, the solid rail, segments of segmented rail, supply conductors and side supply conductors can have a system of evaporative cooling, for example heat-removing pipes (not shown). This barrel is banded by a cylinder or rings (not shown) of high strength structural material, such as steel, which is mounted about the barrel in tight contact therewith. The structural cylinder serves to resist the strong outward pressure exerted on the solid rail 20, the segmented rail 21, the supply conductors 24*a* and 24*b* and side supply conductors 25 and 26 during the acceleration of the projectile.

Figure 8:
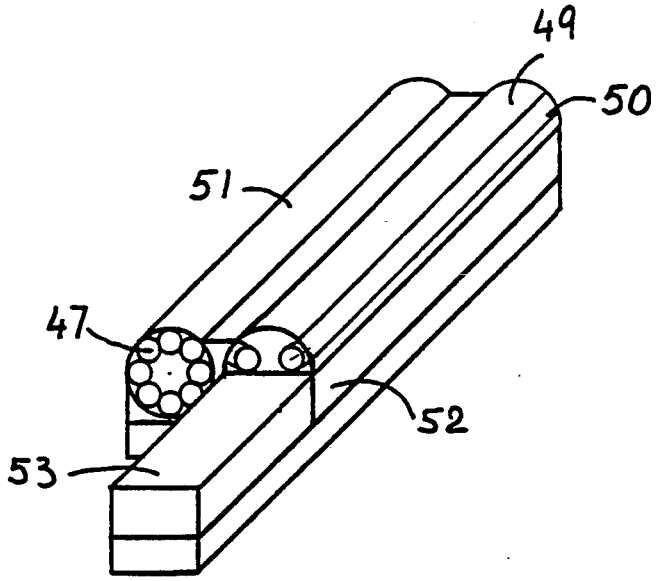
FIG. 8 is a perspective view of the railgun system.

FIG. 8 illustrates the railgun system with the barrel of FIG. 7. Firing chamber 49 has gaps 50 to hold the barrels 47. Loading chamber 51 charges the firing chamber by new barrels and takes outgoing barrels. Any number of gaps may be employed in chambers. A lock 52 closes the gap 50 with the barrel before shooting. A propulsion 53 accelerates the projectile for an initial velocity. In the barrel the projectile speed is increased by electromagnetic forces. The firing chamber and the lock of high strength structural material surround the barrel and protect it from high magnetic pressure. A regular artillery cannon may be used for propulsion. The barrel can have any desired cross-sectional shape, as long as it corresponds to the cross-sectional shape of the projectile. FIG. 9A to 9C illustrate three cross-sectional barrel shapes: circular, square and rectangular, respectively.

The above embodiment discusses the case in which the number of pairs of rails is one. However, this invention has the same effect in the case of two pairs of rails or more. FIG. 10 illustrates the cross-section of a circular barrel with two pairs of rails.

To increase the stability of the projectile the inner surface of the barrel has spiral grooves 54 to spin the projectile during its acceleration in the barrel. FIG. 11A to 11C illustrate two cross-sections of a circular barrel and one cross-sectional view down the length of the barrel, respectively. Spiral projections 55 may be used instead of spiral grooves (see FIG. 11*b*). The best location of spiral grooves or projections is the surface of rails (see FIG. 11C).

Changes may be made in the construction and arrangement of the parts or elements of the embodiment as disclosed herein without departing from the spirit or scope of the invention as defined in the following claims.

I claim:

1. A Segmented Electromagnetic Launcher, comprising a solid rail and a segmented rail, formed from segments with number of said segments greater than one, isolated from one another, said two rails positioned parallel to and spaced apart from one another and formed a barrel with breech and muzzle ends for sliding a projectile inside said barrel, two supply conductors positioned on either side and parallel to said solid rail and isolated from it, side supply conductors positioned on either side of the bore of said barrel with the number of said side supply conductors two times the number of said segments, each said segment connected with two said supply conductors by two said side supply conductors in connection points located at the breech end of each said segment, said solid rail and both of said supply conductors having electrical terminals disposed close to one another and forming one group from three said electrical terminals, two single phase identical sources of electrical power wherein two of the same polarity terminals are connected together and with said terminal of said solid rail, another two terminals of the opposite polarity of said single phase identical sources of electrical power are connected with said terminals of said supply conductors, said rails, said supply conductors and said side supply conductors are formed from conductive material and isolated one from another with insulating layers.

* * * * *